US010415802B1

(12) United States Patent
Huddleston

(10) Patent No.: US 10,415,802 B1
(45) Date of Patent: Sep. 17, 2019

(54) LINEAR LIGHTING FIXTURE CONNECTION

(71) Applicant: GE Lighting Solutions, LLC, East Cleveland, OH (US)

(72) Inventor: Charles Leigh Huddleston, Cleveland, OH (US)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 16/029,048

(22) Filed: Jul. 6, 2018

(51) Int. Cl.
*F21V 21/005* (2006.01)
*F21V 27/00* (2006.01)

(52) U.S. Cl.
CPC ..... *F21V 21/005* (2013.01); *F21V 27/00* (2013.01)

(58) Field of Classification Search
None
See application file for complete search history.

(56) References Cited

U.S. PATENT DOCUMENTS

2002/0080606 A1* 6/2002 Yaphe ..... F21S 8/06 362/219
2002/0136001 A1* 9/2002 Lefkovitz ..... E04B 9/006 362/147
2018/0135817 A1 5/2018 Germain

* cited by examiner

*Primary Examiner* — Ashok Patel
(74) *Attorney, Agent, or Firm* — Buckley, Maschoff & Talwalkar, LLC

(57) ABSTRACT

A linear lighting fixture abutment mechanism including a first portion having a first structure and a second portion having a second structure each portion mounted on a longitudinal wall of respective lighting fixture housings, the first portion and the second portion located at a position proximate to a respective lateral edge of the lighting fixtures. The first structure and the second structure configured to interlock together to retain respective lateral edges of the first and the second lighting fixtures in rigid proximity. The abutment mechanism device configured to generate opposing longitudinal forces on the first and the second lighting fixtures, the opposing longitudinal forces generated by a force that is at least one of movement along a lateral axis and a moment about the lateral axis.

10 Claims, 5 Drawing Sheets

LINEAR LIGHTING FIXTURE CONNECTION

BACKGROUND

Lighting for large, indoor spaces (e.g., manufacturing, assembly, office cubicle barns, and the like) can be achieved by illuminating the space with one or more rows of linear lighting fixtures. These rows of linear lighting fixtures are conventionally formed by abutting individual linear lighting fixtures end-to-end. Individual linear lighting fixtures are typically available in lengths of 2-8 feet.

FIG. 1 depicts an isometric drawing of conventional linear lighting fixture 100. The lighting fixture includes housing 110 that can be formed from, for example, sheet metal, extrusion, or an assembly of components. Housing 110 includes a pair of opposing longitudinal walls 112, and a pair of opposing lateral walls (or edges) 114. These walls define an interior volume in which a lamp (e.g., tubular form fit) can be disposed. Inside the interior volume electrical contacts, connections, driver electronics, and mechanical features can be disposed. Interior surface(s) of this interior volume can act as a reflector for light emitted from the lamp. The interior volume can be closed off by optical element 116 (e.g., a lens and/or diffuser).

Two or more linear lighting fixtures can be joined by adding mechanical connectors to the lighting fixture. The conventional approach is to mount a mechanical connector to lateral ends of abutting lighting fixtures, once the lighting fixture is suspended in place. To mount the mechanical connectors, the lighting fixture requires disassembly of many components (e.g., the diffuser, lamp removal, and oftentimes electrical connectors as well).

Mechanical connectors can be first mounted to each lighting fixture's housing 110 with multiple fasteners (e.g., rivets, self-tapping screws, bolt/nut combinations, and the like). The lighting fixtures are then abutted by joining (for example, flanges) of two mechanical connectors together using additional fasteners. Reassembly of the components removed from each lighting fixture is then necessary.

The fixture disassembly, connector mounting, fixture abutment, and fixture reassembly is often occurring at a distance above the floor, and in limited access conditions. These conditions result in labor intensive operations, and the disassembly/reassembly of the fixture can degrade the integrity of the lighting fixture itself.

What is needed in the art is an apparatus and method for joining linear lighting fixtures in the field, where simple operations can be performed in limited access conditions that do not impact the integrity of the abutted linear lighting fixtures and do not require disassembly of the lighting fixture to install.

DESCRIPTION

Embodying abutment mechanisms and methods abut individual linear lighting fixtures by exerting a force along, and/or a moment about, a lateral axis to create a longitudinal force that brings the lighting fixtures together along a longitudinal axis.

In accordance with embodiments, adjacent lighting fixtures are secured together rigidly and with a minimally visible seam. Embodying abutment mechanisms can be within the interior volume of lighting fixture housing 110, and can be implemented with all fasteners and other hardware located within the lighting fixture housing interior volume. Lighting fixture linear rows that incorporate embodying devices result in lighting elements that do not have brackets, fasteners, and other components on external visible surfaces. By abutting lighting fixtures using embodying devices and methods, the resulting linear lighting row is more aesthetically appealing than conventional approaches (by not having external mounting brackets, flanges, and fasteners). The resulting linear lighting row has an improved abutment seam over conventional techniques (thus, less light leakage). The resulting linear lighting row can be assembled without the need to extensively disassemble the individual, constituent lighting fixtures. Thus, the integrity of each lighting fixture is maintained. Embodying devices and methods provide for reduced installation time and improved linear lighting rows.

An embodying abutment mechanism includes a first portion mounted on a longitudinal wall of a first lighting fixture, and a second portion mounted on a longitudinal wall of a second lighting fixture. The first and the second portions can be attached to the longitudinal wall. In some implementations one or both of the first and second portions can be formed as an integral part of the longitudinal wall.

Opposing pairs of first and second portions can include opposing mating and/or interlocking elements that bring the two lighting fixtures together by movement of the fixtures along a longitudinal axis. In accordance with embodiments, the opposing mating and/or interlocking elements are drawn together by exertion of a force along, and/or a moment about, a lateral axis (i.e., perpendicular to the longitudinal axis of fixture movement). These mating and/or interlocking elements can fixedly secure the two lighting fixtures in relation to one another.

Figure 1:
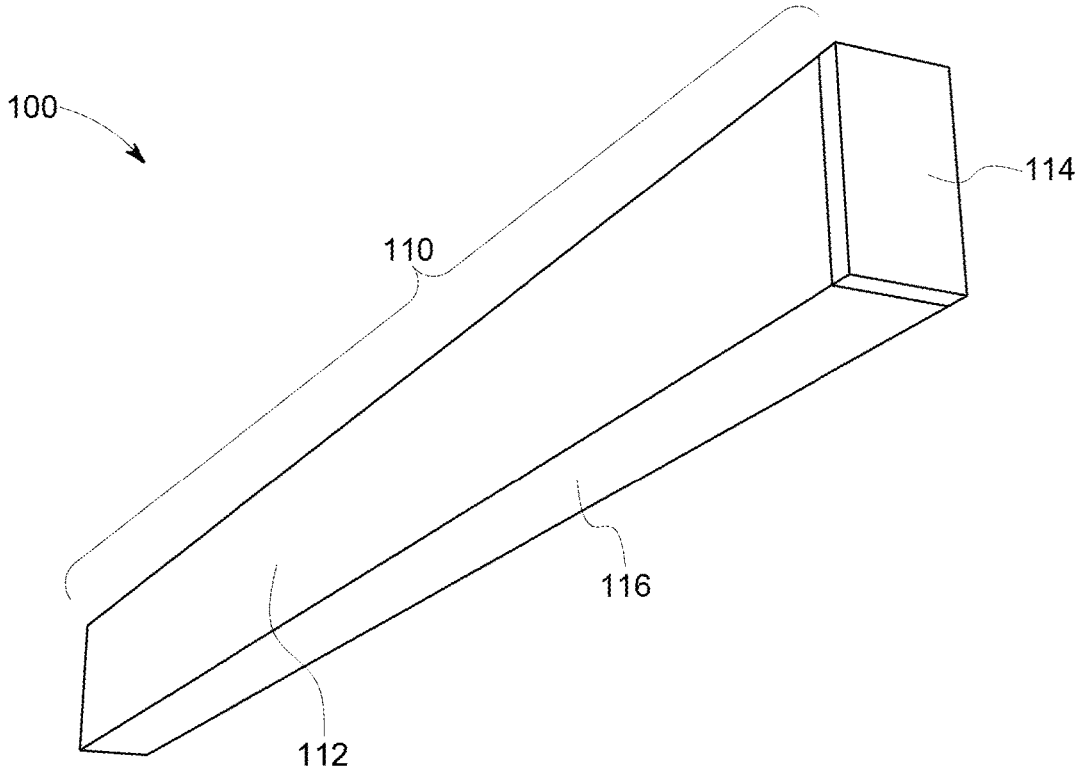
FIG. 1 PRIOR ART
FIG. 1 depicts a conventional linear lighting fixture.
Figure 2:
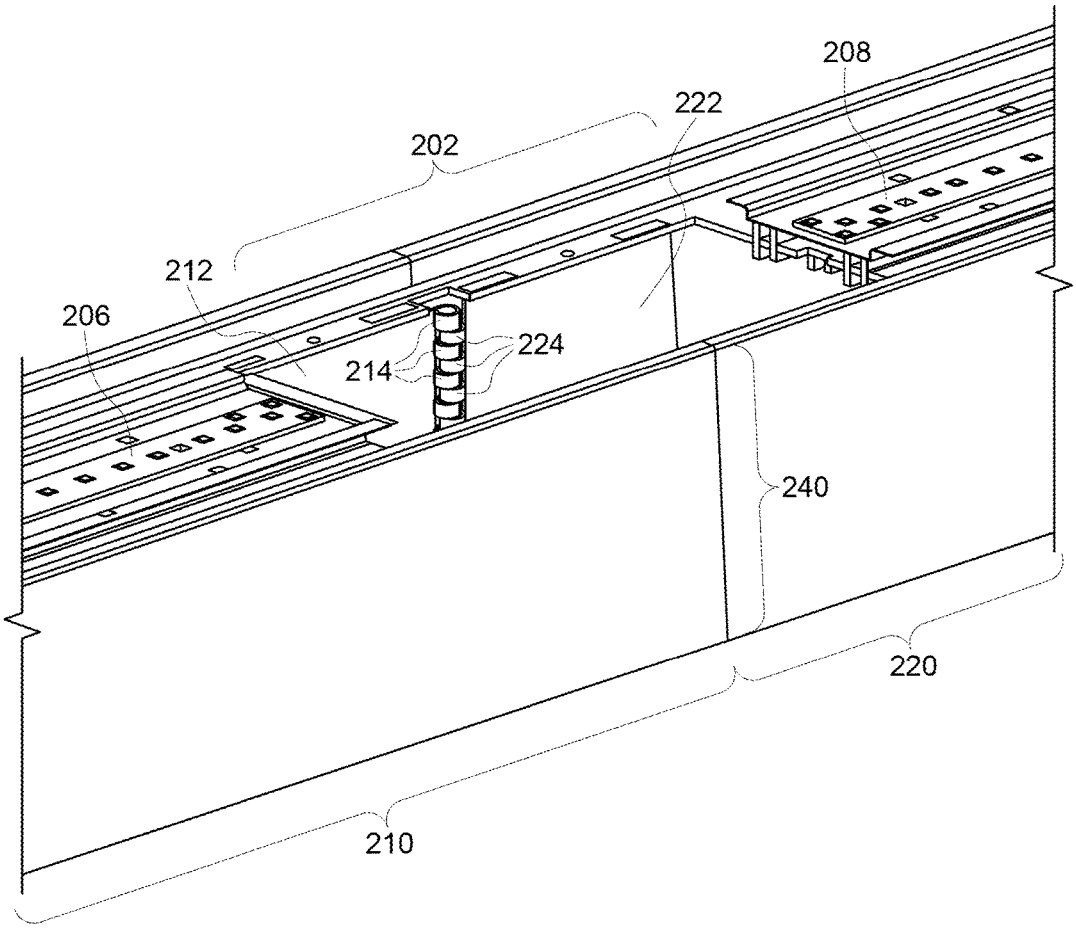
FIG. 2 depicts portions of two lighting fixtures having an abutment mechanism in accordance with embodiments.

FIG. 2 depicts portions of two lighting fixtures 210, 220 having abutment mechanism 202 in accordance with embodiments. In the illustrated example, lighting fixtures 210, 220 include LED lamp 206, 208. However, it should be readily understood that the type and/or nature of the lamp is not a limitation on any embodiment.

Embodying abutment mechanism 202 includes first portion 212 and second portion 222. The first portion and the second portion are located on longitudinal walls of respective lighting fixtures, and at opposing lateral edges of the lighting fixtures.

In accordance with embodiments, first portion 212 includes a first set of knuckles 214 located at an edge proximate to the lateral edge of lighting fixture 210. Similarly, second portion 222 includes a second set of knuckles 224 located at an edge proximate to the lateral edge of lighting fixture 220. Illustrated embodiments depict the knuckles as closed. However, embodiments are not so limited. The knuckles can be implemented in the form of a loop, joint, node or curl.

In accordance with embodiments, the first set and the second set of knuckles are positioned at opposing and offset complementary locations, so that the two sets of knuckles can interlock when a force along, or a moment about, the lateral axis is exerted. This laterally-orientated force causes the two lighting fixtures to be drawn together along a longitudinal axis.

Figure 3:
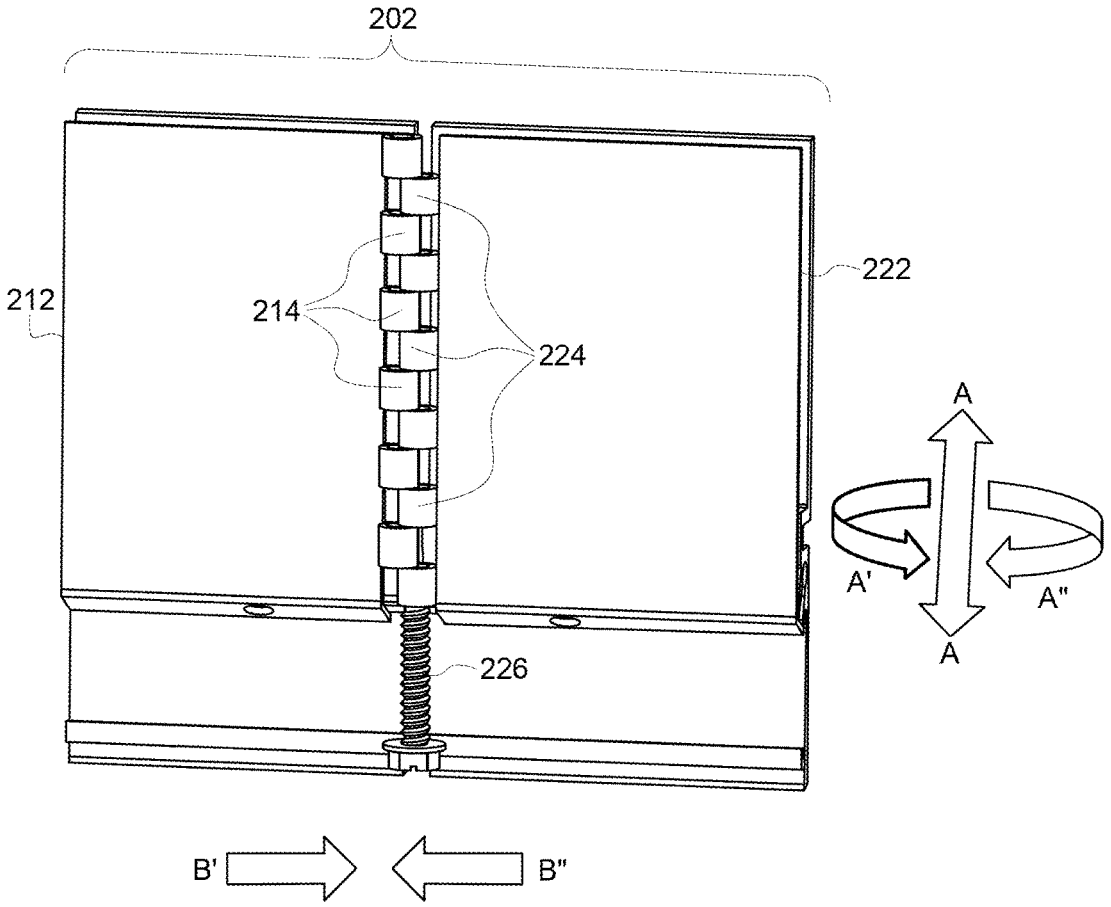
FIG. 3 depicts a front view of the abutment mechanism of FIG. 2 in accordance with embodiments.

FIG. 3 depicts a front view of abutment mechanism 202 in accordance with embodiments. In accordance with embodiments, first knuckles set 214 and second knuckles set 224 can be positioned non-concentrically along lateral axis AA. As pin 226 moves along the lateral axis, it traverses through alternating knuckles. The lateral movement of the pin generates opposing longitudinal forces B', B". These opposing longitudinal forces result in lighting fixtures 210, 220 to be brought together so that their lateral edges are adjacent.

In accordance with embodiments, pin 226 can be threaded (as illustrated in FIG. 3). However, in other embodiments, the pin need not be threaded. If pin 226 and inner surfaces of the knuckles are threaded, then as pin 226 is rotated about lateral axis AA, moment A', A" are generated (depending on the direction of rotation). This rotation about the lateral axis causes the pin to move along the lateral axis, which in turn generates opposing longitudinal forces B', B". In accordance with embodiments, pin 226 can be sufficiently long to traverse both sets of knuckles, or two pins can be used by insertion from opposite ends of the knuckles.

Figure 4A:
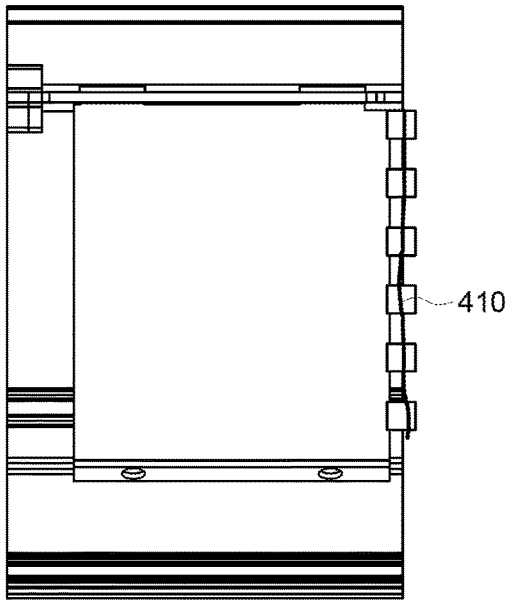
FIGS. 4A-4C depict different longitudinal force profiles generated by the abutment mechanism of FIG. 2.
Figure 4B:
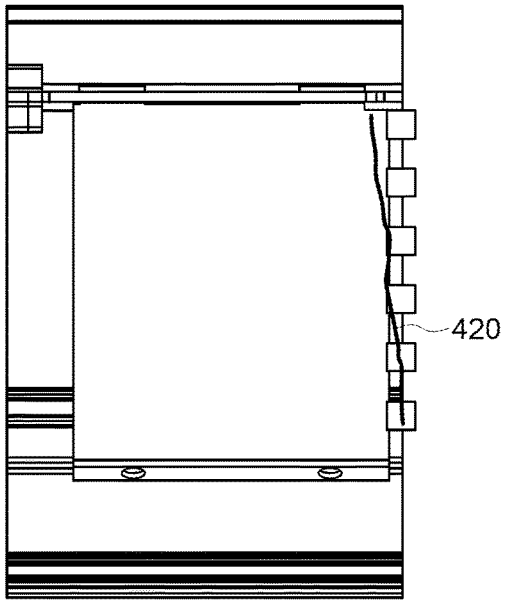
Figure 4C:
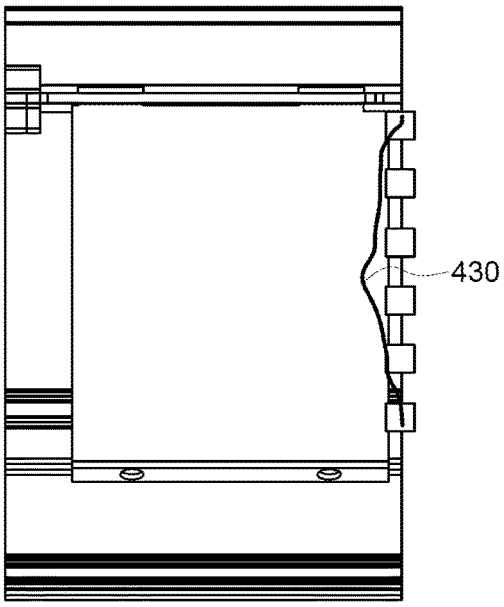

FIGS. 4A-4C depict longitudinal force profiles 410, 420, 430 generated by abutment mechanism 202 in accordance with embodiments. The non-concentric knuckles of both portions 210, 220 of the abutment mechanism need not be placed along a single vertical row. By displacing the knuckles, the geometry can be used to yield different longitudinal force profiles 410, 420, 430. Higher longitudinal forces can be generated along the length of pin 226, which more securely cause the two lighting fixtures to abut each other.

Figure 5:
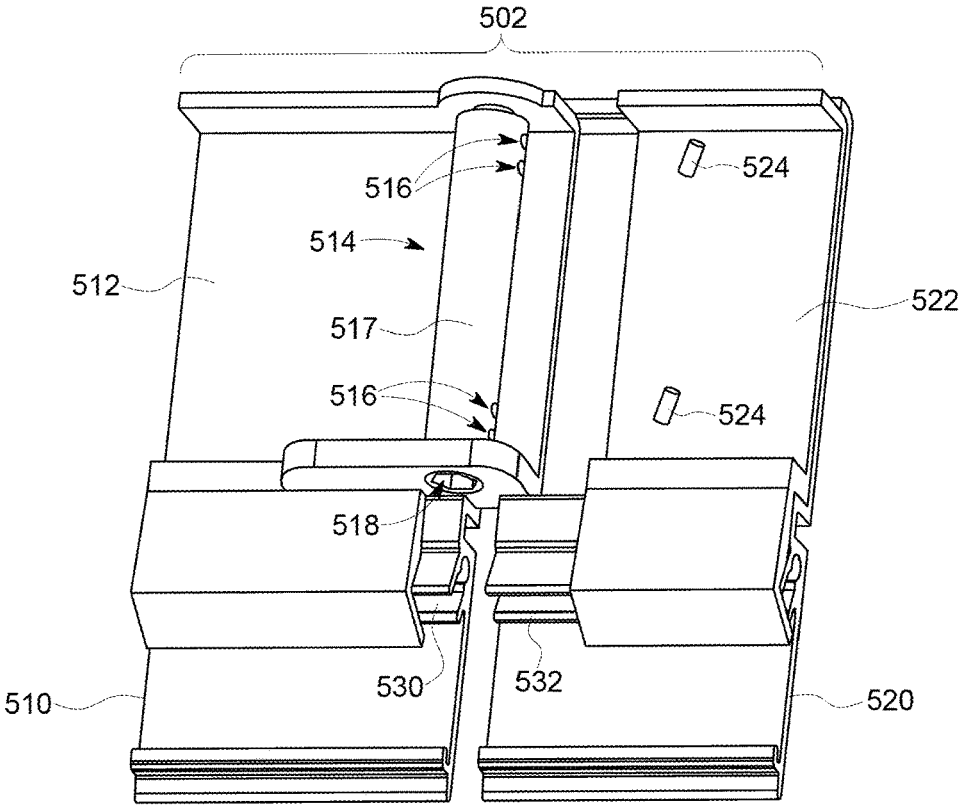
FIG. 5 depicts an abutment mechanism in accordance with embodiments.

FIG. 5 depicts abutment mechanism 502 in accordance with embodiments. Abutment mechanism 502 includes first portion 512 located on an interior longitudinal housing wall of lighting fixture 510. Abutment mechanism 502 includes second portion 522 located on an interior longitudinal housing wall of lighting fixture 520. The first and the second portions of abutment mechanism 502 are positioned at opposing lateral edges the respective lighting fixture housings.

First portion 512 includes cable winder 514. The cable winder includes shaft 517 having openings 516, through which a cable can be secured to the cable winder shaft. The cable winder includes keyway 518 that can accept a key (e.g., a hex key, or other form).

Second portion 522 includes one or more posts 524 protruding from the second portion. A cable attached to the cable winder 514 can be secured to one or more posts 524. Rotation of the cable winder about the lateral axis results in generating a longitudinal force that draws together the lateral edges of lighting fixtures 510, 520.

First portion 512 includes interlocking profile 530. Second portion 522 includes interlocking profile 532. Interlocking profiles 530, 532 mesh together to provide rigidity and stability to the seam where the first and second lighting fixtures abut. In accordance with embodiments, the laterally-orientated force generated by the movement about the lateral axis causes the two lighting fixtures to be drawn together along a longitudinal axis.

In accordance with embodiments, cable winder 514 can include an anti-backlash feature to retain the cable as it is wound around shaft 517. The anti-backlash feature can be, for example, a pawl/cog ratchet mechanism, a one-way bearing mechanism, and the like.

Although specific hardware and methods have been described herein, note that any number of other configurations may be provided in accordance with embodiments of the invention. Thus, while there have been shown, described, and pointed out fundamental novel features of the invention, it will be understood that various omissions, substitutions, and changes in the form and details of the illustrated embodiments, and in their operation, may be made by those skilled in the art without departing from the spirit and scope of the invention. Substitutions of elements from one embodiment to another are also fully intended and contemplated. The invention is defined solely with regard to the claims appended hereto, and equivalents of the recitations therein.

The invention claimed is:

1. A linear lighting fixture abutment mechanism comprising:

a first portion mounted on a longitudinal wall of a first lighting fixture housing, the first portion including a first structure, the first lighting fixture housing including a lateral edge;

a second portion mounted on a longitudinal wall of a second lighting fixture housing, the second portion including a second structure, the second lighting fixture housing including a lateral edge;

the first portion and the second portion located at a position proximate to the lateral edge of respective first and second lighting fixture housings;

the first structure and the second structure configured to interlock together to retain the lateral edges of the first and the second lighting fixture housings in rigid proximity; and the abutment mechanism configured to generate opposing longitudinal forces on the first and the second lighting fixture housings, the opposing longitudinal forces generated by a force that is at least one of movement along a lateral axis of the first or the second lighting fixture housings and a movement about the lateral axis.

2. The mechanism of claim 1, including:

the first structure having a first set of knuckles;

the second structure having a second set of knuckles;

the first and the second set of knuckles positioned at opposing and offset complementary locations along the lateral axis;

a pin insertable into alternating ones of the first and second set of knuckles to generate the opposing longitudinal forces; and the opposing longitudinal forces drawing the first and the second sets of knuckles into an interlocking arrangement.

3. The mechanism of claim 2, including the pin insertable into the first and second set of knuckles by at least one of a linear movement along the lateral axis and a rotation about the lateral axis.

4. The mechanism of claim 2, including the first set of knuckles having a spatial center that is non-concentric with the spatial center of at least an adjacent knuckle.

5. The mechanism of claim 2, including the second set of knuckles having a spatial center that is non-concentric with the spatial center of at least an adjacent knuckle.

6. The mechanism of claim 2, including each of the first set and second set of knuckles having a spatial center that is non-concentric with the spatial center of the opposing complementary knuckle.

7. The mechanism of claim 1, including:

the first portion having a cable winder and a first interlocking profile; and the second portion having one or more posts and a second interlocking profile.

8. The mechanism of claim 7, including:

rotation of the cable winder generating the opposing longitudinal forces; and the opposing longitudinal forces drawing the first and the second interlocking profiles into an interlocking arrangement.

9. The mechanism of claim 8, the cable winder including an anti-backlash feature, the anti-backlash feature being one of a ratchet mechanism and a one-way bearing mechanism.

10. The mechanism of claim 1, including:

the cable winder having a shaft with one or more openings, the openings configured to receive and secure a cable;

the cable winder including a moveable keyway, the keyway configured to generate rotation of the cable winder about the lateral axis; and the posts configured to receive and secure the cable.

* * * * *